United States Patent [19]

Yamamura

[11] Patent Number: 4,951,038

[45] Date of Patent: Aug. 21, 1990

[54] APPARATUS FOR DISPLAYING A SPRITE ON A SCREEN

[75] Inventor: Kimio Yamamura, Tokyo, Japan

[73] Assignee: Hudson Soft Co., Ltd., Hokkaido, Japan

[21] Appl. No.: 160,154

[22] Filed: Feb. 25, 1988

[30] Foreign Application Priority Data

| | | | |
|---|---|---|---|
| May 15, 1987 | [JP] | Japan | 62-118595 |
| May 15, 1987 | [JP] | Japan | 62-118596 |
| May 20, 1987 | [JP] | Japan | 62-123050 |
| Sep. 25, 1987 | [JP] | Japan | 62-241172 |

[51] Int. Cl.[5] ..... G09G 5/30

[52] U.S. Cl. ..... 340/725; 340/724; 340/747

[58] Field of Search ..... 340/725, 735, 747, 748, 340/724; 273/84 G, 1 E; 324/77 B; 434/157; 84/484

[56] References Cited

U.S. PATENT DOCUMENTS

| | | | |
|---|---|---|---|
| 4,324,401 | 4/1982 | Stubben et al. | 340/725 |
| 4,462,594 | 7/1984 | Bromley et al. | 273/85 G |
| 4,510,840 | 4/1985 | Inami et al. | 324/77 B |
| 4,546,690 | 10/1985 | Tanaka et al. | 84/484 |
| 4,552,360 | 11/1985 | Bromley et al. | 273/85 G |
| 4,672,541 | 6/1987 | Bromley et al. | 273/1 E |
| 4,710,877 | 12/1987 | Ahmed | 434/157 |
| 4,813,671 | 3/1989 | Charpentier | 340/725 |

FOREIGN PATENT DOCUMENTS 11390 2/1982 Japan .

OTHER PUBLICATIONS

Guttag et al-"Video Display Processor Simulates Three Dimensions"-Electronics-Nov./20/80-pp. 123-126.

Guttag et al-"Video Display Processor"-IEEE Transaction Consumer Electronics, vol. CE-27, Feb. 1981-pp. 27-34.

*Primary Examiner*—Alvin Oberley
*Assistant Examiner*—M. Fatahiyar
*Attorney, Agent, or Firm*—Lowe, Price, LeBlanc, Becker & Shur

[57] ABSTRACT

Apparatus for displaying a sprite on a screen comprises sprite attribute tables each including coordinates indicating a display position of a sprite, a pattern code defining the sprite in regard to pattern data, and control data defining a display mode of the sprite. A sprite generator is addressed in accordance with the pattern code to supply the pattern data of a sprite to a pattern data buffer. The sprite is displayed in accordance with the coordinates thereof on the screen. Therefore, the sprite is moved on the screen only by changing the coordinates of a corresponding sprite attribute table.

4 Claims, 16 Drawing Sheets

FIG. 3 A

ADDRESS REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| | | | | | | | | | | | AR | | | | |

FIG. 3 B

STATUS REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| ← | | | | | 0 | | | | BSY | VD | DV | DS | RR | OR | CR |

FIG. 3 C

MEMORY ADDRESS WRITE REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| MAWR | | | | | | | | | | | | | | | |

FIG. 3 D

MEMORY ADDRESS READ REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| MARR | | | | | | | | | | | | | | | |

FIG. 3E

VRAM DATA WRITE REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| VWR | | | | | | | | | | | | | | | |

FIG. 3F

VRAM DATA READ REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| VRR | | | | | | | | | | | | | | | |

FIG. 3G

CONTROL REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| | | | IW | | DR | TE | | BB | SB | EX | | IE | | | |

FIG. 3H

RASTER DETECTING REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| | | | | | | RCR | | | | | | | | | |

FIG. 3 I

BGX SCROLL REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| | | | | | | BXR | | | | | | | | | |

FIG. 3 J

BGY SCROLL REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| | | | | | | | BYR | | | | | | | | |

FIG. 3 K

MEMORY WIDTH REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| | | | | | | | | CM | SCREEN | | | SM | | VM | |

FIG. 3 L

HORIZONTAL PERIOD REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| | HDS | | | | | | | | | | HSW | | | | |

FIG. 3M

HORIZONTAL DISPLAY REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| X | HDE | | | | | | | X | HDW | | | | | | |

FIG. 3N

VERTICAL SYNCHRONISM REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| VDS | | | | | | | | X | | | VSW | | | | |

FIG. 3O

VERTICAL DISPLAY REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| X | | | | | | | VDW | | | | | | | | |

FIG. 3P

VERTICAL DISPLAY END POSITION REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| X | | | | | | | | VCR | | | | | | | |

FIG. 3Q

DMA CONTROL REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| | | | | | | | | | | | DSR | DI/D | SI/D | DVC | DSC |

FIG. 3R

DMA SOURCE ADDRESS REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| SOUR | | | | | | | | | | | | | | | |

FIG. 3S

DMA DESTINATION ADDRESS REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| DESR | | | | | | | | | | | | | | | |

FIG. 3T

DMA BLOCK LENGTH REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| LENR | | | | | | | | | | | | | | | |

FIG. 3U

DMA VRAM-SATB SOURCE ADDRESS REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| DVSSR | | | | | | | | | | | | | | | |

APPARATUS FOR DISPLAYING A SPRITE ON A SCREEN

FIELD OF THE INVENTION

The invention relates to an apparatus for displaying a sprite on a screen, and more particularly to an apparatus for displaying a sprite on a screen in which an image unit composed of a plurality of dots which is called a "sprite" is moved to be displayed on such a screen as a CRT display and so on.

BACKGROUND OF THE INVENTION

One of apparatuses for displaying an image unit composed of a plurality of dots on a CRT display is described in Japanese Patent Laid-open No. 11390/1982. In the apparatus for displaying an image unit on a CRT display, the image unit is moved on the CRT display in accordance with the subtraction between X value of standard coordinates of the image unit and a vertical standard line, and between Y value of the standard coordinates and a horizontal standard line. In controlling the image unit to be moved on the CRT display, control signals for two adjacent horizontal scanning lines are alternately written into two line buffer memories which are provided in parallel and alternately read from the memories so that image signals read from a character image memory are processed in accordance with the control signals thus read from the line buffer memories, thereby being displayed on the CRT display. The control signals comprise signals of the aforementioned substractions in the X and Y directions so that the image unit is moved smoothly on the CRT display by increasing or decreasing the subtraction signal at an appropriate displaying time.

According to the apparatus for displaying an image unit on a CRT display, however, there is a disadvantage that a memory region is increased because the character image memory is accessed after the control signals for the image unit are once written into the parallel line buffer memories.

There is a further disadvantage that enlarging the size of an image unit is difficult to be performed.

There is a still further disadvantage that, where the number of image units which are designated to be displayed on a CRT display exceeds a predetermined number, an image unit exceeding the predetermined number is not displayed on the CRT display.

There is a yet still further disadvantage that there are provided additional registers into which the so-called "blanking mode" instruction is stored to perform the blanking mode wherein an image unit is moved from the edge of a CRT display to appear thereon or is moved to the edge thereof to disappear therefrom.

SUMMARY OF THE INVENTION

Accordingly, it is an object of the invention to provide an apparatus for displaying a sprite on a screen in which line buffer memories for storing control signals for a sprite are not necessary to be provided.

It is a further object of the invention to provide an apparatus for displaying a sprite on a screen in which the size of a sprite is easily controlled to be changed on a screen.

It is a still further object of the invention to provide an apparatus for displaying a sprite on a screen in which, where sprites more than a predetermined number to be displayed on a single horizontal scanning line are designated, the occurrence of such a designation is indicated.

It is a yet still further object of the invention to provide an apparatus for displaying a sprite on a screen in which the aforementioned blocking mode is easily performed.

According to the invention, an apparatus for displaying a sprite on a screen comprises, sprite attribute tables each for including coordinates indicating a display position of a sprite, a pattern code defining said sprite in regard to pattern data, and control data defining a display mode of said sprite, first detection means for comparing a vertical position value of said coordinates with a raster number to detect a sprite to be displayed, a sprite generator storing pattern data of said sprite, second detection means for comparing a horizontal position value of said coordinates of said sprite to be displayed with a dot clock signal to detect pattern data to be displayed, and means for controlling said screen to display said sprite to be displayed thereon in accordance with said pattern data to be displayed.

BRIEF DESCRIPTION OF THE DRAWINGS

The invention will be explained in detail in conjunction with drawings wherein,

FIGS. 3A to 3U are explanatory diagrams showing registers included in a control unit of the video display controller in FIG. 2A.

DESCRIPTION OF PREFERRED EMBODIMENTS

Figure 1:
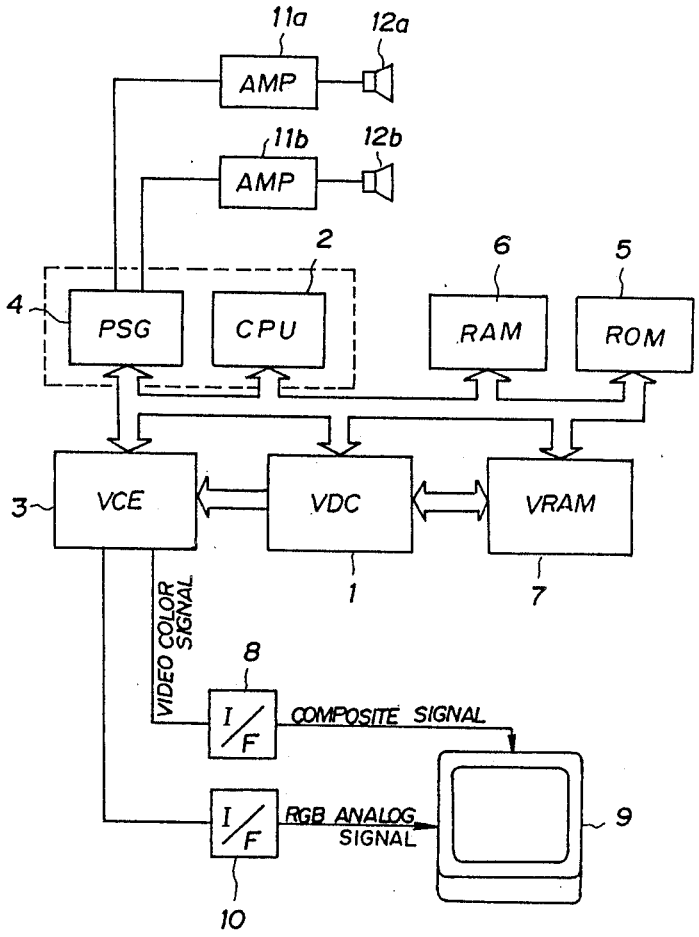
FIG. 1 is a block diagram showing an apparatus for displaying an image on a screen in which an apparatus for displaying a sprite on a screen according to the invention is included.

In FIG. 1, there is shown an apparatus for displaying an image on a screen which is mainly composed of a video display controller 1, a CPU 2, a video color encoder 3, and a programmable sound generator 4. The video display controller 1 supplies the video color encoder 3 with image data for a story which are read from a VRAM 7 under the control of the CPU 2 reading a program stored in a ROM 5. The CPU 2 controls a RAM 6 to store data, calculation or arithmetical results etc. temporarily in accordance with a program stored in the ROM 5. The video color encoder 3 is supplied with image data to produce RGB analog signals or video color signals including luminance signals and color difference signals to which the RGB signals are matrix-converted by using color data stored therein. The programmable sound generator 4 is controlled by the CPU 2 reading a program stored in the ROM 5 to produce audio signals making left and right stereo sounds. The video color signals produced at the video color encoder 3 are of composite signals supplied through an interface 8 to a television set 9, while the RGB analog signals are directly supplied to a CRT of the television set 9 which is used as an exclusive monitor apparatus. The left and right analog signals supplied from the programmable sound generator 4 are amplified at amplifiers 11*a* and 11*b* to make sounds at speakers 12*a* and 12*b*.

Figure 2A:
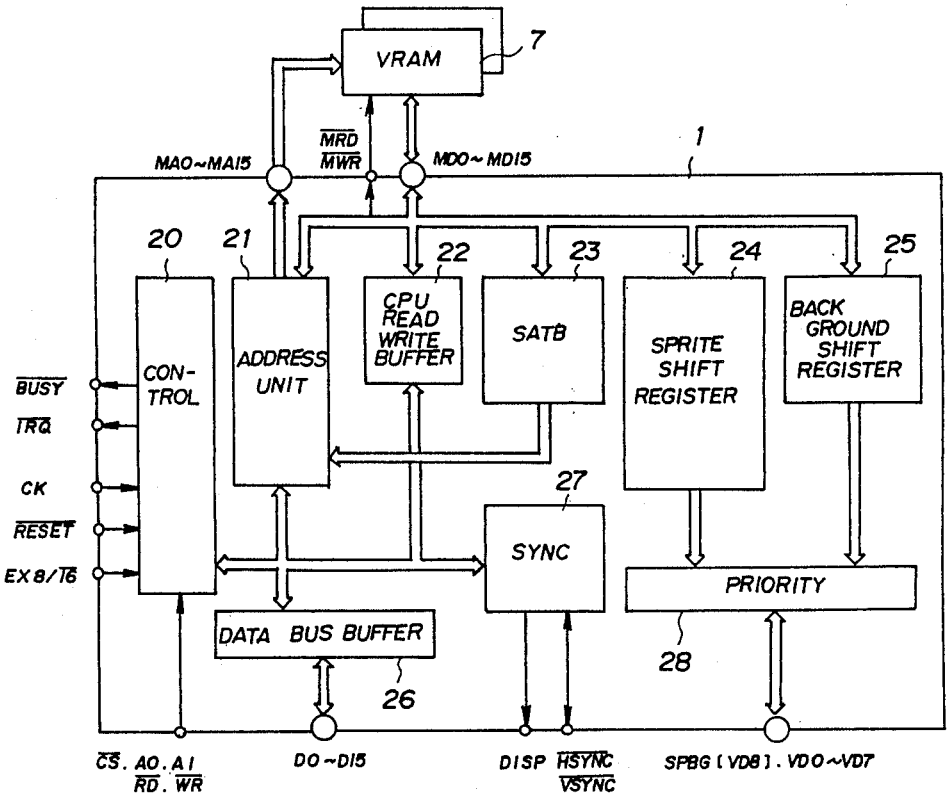
FIG. 2A is a block diagram showing a video display controller for the control of writing video signals into a VRAM and reading video signals therefrom.

In FIG. 2A, there is shown the video display controller 1 transferring data between the CPU 2 and VRAM 7 which comprises a control unit 20 including various kinds of registers to be described later, an address unit 21, a CPU read/write buffer 22, and sprite shift register 24, a background shift register 25, a data bus buffer 26, a synchronic circuit 27, and a priority circuit 28.

The control unit 20 is provided with a $\overline{BUSY}$ terminal being "L" to keep the CPU 2 writing data into the VRAM 7 or reading data therefrom in a case where the video display controller 1 is not in time for the writing or reading of the date, an $\overline{IRQ}$ terminal supplying an interruption request signal, a CK terminal receiving a clock signal of a frequency for one dot (one picture element), a $\overline{RESET}$ terminal receiving a reset signal for initializing the video display controller 1, and an EX $8/\overline{16}$ terminal receiving a data bus width signal for selecting one of 8 and 16 bit data buses.

The address unit 21 is connected to terminals MA0 to MA15 supplying address signals for the VRAM 7 which has, for instance, a special address region of 65,536 words. The address unit 21, CPU read/write buffer 22, sprite attribute table 23, sprite shift register 24, and background shift register 25 are connected to terminals MD0 to MD15 through which data are transferred to and from the VRAM 7.

The sprite attribute table buffer 23 is a memory for storing X and Y display positions, pattern codes and control data of sprites each composed of 16×16 dots as described in more detail later.

The sprite shift register 24 stores pattern and color data of a sprite read from a sprite generator in the VRAM 7 which is accessed in accordance with the pattern codes stored in the sprite attribute table 23 as described in more detail later.

The background shift register 25 stores pattern data, along with CG color, read from a character generator in the VRAM 7 in accordance with an address based on a character code of a background attribute table in the VRAM 7 which is accessed in an address decided by a raster position as also described in more detail later.

The data bus buffer 26 is connected to terminals D0 to D15 through which data are supplied and received. In the video display controller 1, 8 or 16 bit interface is selected to comply with a data width of a system including the CPU2 wherein the terminals D0 to D7 among the terminals D0 to D15 are occupied when the 8 bit interface is selected.

The synchronic circuit 27 is connected to a DISP terminal indicating a display period, a $\overline{VSYNC}$ terminal from which a vertical synchronous signal for a CRT screen is supplied and in which an external vertical synchronous signal is received, and a $\overline{HSYNC}$ terminal from which a horizontal synchronous signal for a CRT screen is supplied and in which an external horizontal synchronous signal is received.

The priority circuit 28 is connected to terminals VD0 to VD7 through which video signals are supplied, and a SPBG (VD8) terminal being "H" when the video signals are of a sprite and being "L" when the video signals are of a background.

The aforementioned control unit 20 is also connected to a CS terminal being "L" wherein the CPU 2 is able to read data from registers therein and sprite data thereinto, a RD terminal receiving a clock signal for the reading thereof, a WR terminal receiving a clock signal for the writing thereof, and terminals A0 and A1 which are connected to address bus of the CPU 2. Further, the video display controller 1 is provided with a $\overline{MRD}$ terminal being "L" when the CPU 2 reads data from the VRAM 7, and a $\overline{MWR}$ terminal being "L" when the CPU 2 writes data into the VRAM 7.

Figure 2B:
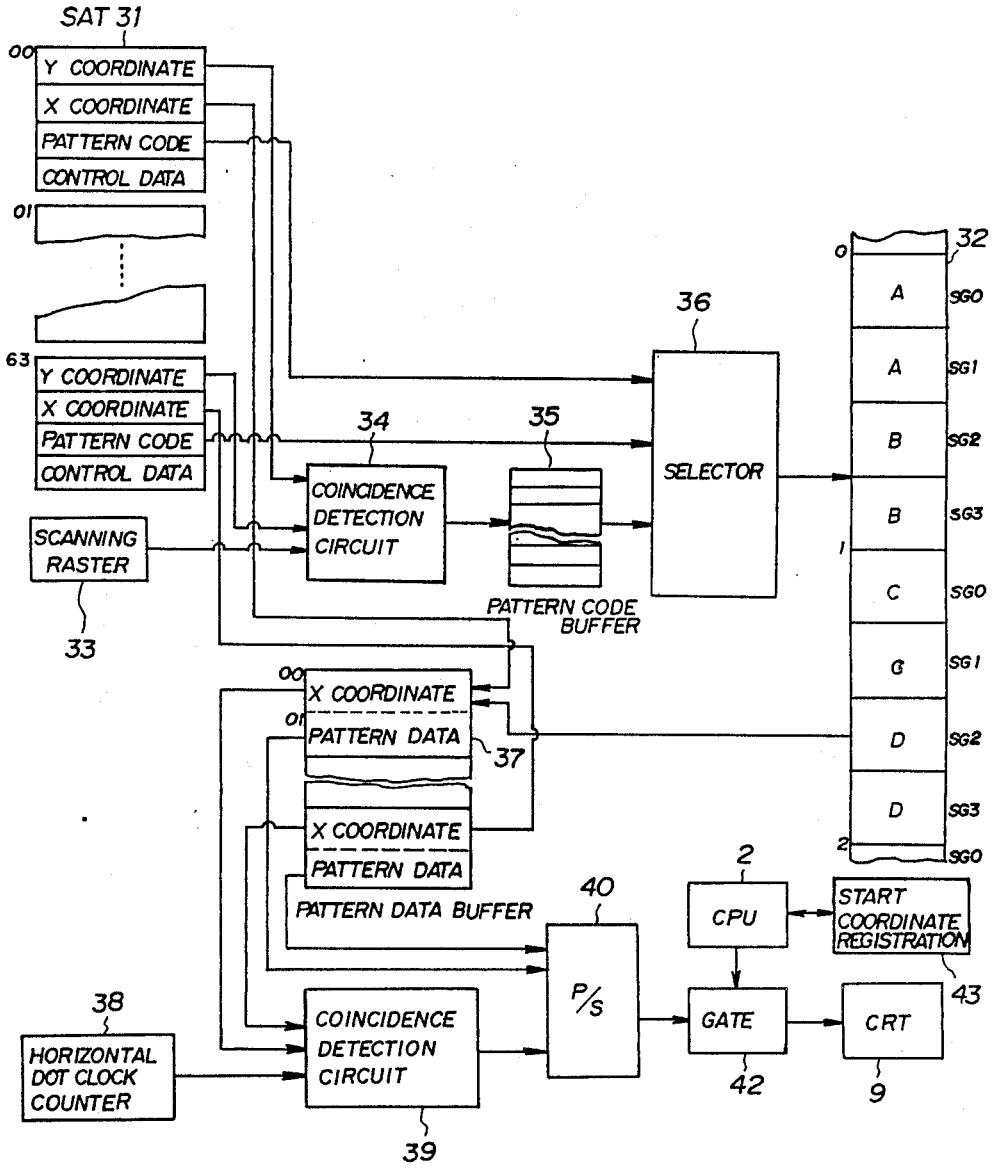
FIG. 2B is a block diagram showing an apparatus for displaying a sprite on a screen in an embodiment according to the invention.

In FIG. 2B, there is shown an apparatus for displaying a sprite on a screen in an embodiment according to the invention wherein the reference numerals 31 and 32 indicate a sprite attribute table and sprite generator in the VRAM 7 respectively. The sprite attribute table 31 can include, for instance, sixty four sprites, while the sprite generator 32 can include, for instance, one thousand and twenty-four sprites. In the sprite attribute table 31, addresses of 0 to 63 are assigned to the sixty-four sprites to give a priority thereto in the order of the address 0>1> >62>63. Each of the sprites is composed of 16×16 bits, and includes X and Y coordinates, pattern codes and control data. As to each of the sprites, the Y coordinate is compared with a raster signal supplied from a scanning raster producing circuit 33 in a coincidence detection circuit 34 whereby sprites each having a Y coordinate coincident with a raster signal are stored into a pattern code buffer 35 which can store a maximum number of sixteen sprites by referring to a corresponding one of the addresses 0 to 63. A selector 36 selects a pattern code of the sprite attribute table 31 in accordance with an address stored in the pattern code buffer 35 to access the sprite generator 32 in regard to an address which is of a selected pattern code, thereby reading pattern data from the sprite generator 32. The pattern data thus obtained are stored into a pattern data buffer 37 along with an X coordinate corresponding thereto read from the sprite attribute table 31. The storing of sprites into the pattern code buffer 35 is performed at a horizontal display period preceding to the present horizontal display period by one scanning raster, while the storing of pattern data into the pattern data buffer 37 is performed at a following horizontal retrace period. When a scanning raster at which pattern data are displayed has come, the X coordinate thus stored in the pattern data buffer 37 is compared with a counted value of a horizontal dot clock counter 38 in a coincidence detection circuit 39 whereby pattern data having an X coordinate coincident with the counted value are supplied to a parallel/serial converting circuit 40. In the parallel/serial converting circuit 40, parallel pattern data are converted into serial pattern data which are supplied through a gate circuit 42 to a CRT screen 9. The gate circuit 42 is controlled to be turned on and off in accordance with a content of a starting coordinates registration circuit 43 by the CPU 2. The content thereof is X and Y coordinates by which the starting coordinates of a display region is defined on a display screen.

In FIGS. 3A to 3U, there are shown various kinds of registers included in the control unit 20 of the video display controller 1.

(a) Address register (FIG. 3A)

A register number "AR" is exclusively written into the address register for designating one of memory address write register to DMA VRAM-SATB source address register as shown FIGS. 3C to 3U so that data are written into the designated register or read therefrom. The address register is selected when a signal is written into the video display controller 1 under the condition that the A1 and $\overline{CS}$ terminals thereof are "L".

In a case where 16 bit data bus is selected, the EX $8/\overline{16}$ terminal is "0", the A1 terminal is "0", the R/W terminal is W, and the A0 terminal is no matter.

In a case where 8 bit data bus is selected, the EX $8/\overline{16}$ terminal is "1", the A0 and A1 terminals are "0", and the R/W terminal is W.

(b) Status register (FIG. 3B)

A bit corresponding to one of interruption jobs is set to be "H" in the status register to make the interruption active when a cause of the interruption which is enabled by an interruption permission bit of a control register and DMA control register as shown in FIGS. 3G and 3Q is occurred. When the status is read from the status register, the corresponding bit is cleared automatically. The status indicating bits are as follows.

(1) bit 0 (CR)—collision of sprites

It is indicated that the sprite number 0 of a sprite is collided with any one of the sprite numbers 1 to 63 of sprites.

(2) bit 1 (OR)—more sprites than a predetermined number (2.1) a case where more than 17 sprites are detected on a single raster line.

(2.2) a case where data of a sprite which is designated are not transferred to a data buffer in a horizontal retrace period.

(2.3) a case where a bit of CGX in control data of a sprite by which two sprites are jointed in a horizontal direction is set so that data of the sprites are not transferred to a data buffer.

(3) bit 2 (PR)—detection of raster

It is indicated that a value of a raster counter becomes a predetermined value of a raster detecting register.

(4) bit 3 (DS)—finishing of DMA transfer

It is indicated that data transfer between the VRAM 7 and sprite attribute table buffer 23 is finished.

(5) bit 4 (DV)—finishing of DMA transfer

It is indicated that data transfer between two regions of the VRAM 7 is finished.

(6) bit 5 (VD)—vertical retrace period

It is indicated that the VRAM 7 accessed for the writing or reading of date by the CPU 2 so that the $\overline{BUSY}$ terminal is "0".

(c) Memory address write register (register number "00", FIG. 3C)

A starting address "MAWR" is written into the memory address write register so that the writing of data begins at the starting address of the VRAM 7.

(d) Memory address read register (register number "01", FIG. 3D)

A starting address "MARR" is written into the memory address read register. When the upper byte of the starting address is written thereinto, data are begun to be read from the starting address of the VRAM 7 so that data thus read are written into a VRAM data read register as shown in FIG. 3F. Thereafter, the starting address "MARR" is automatically incremented by one.

(e) VRAM data write register (register number "02", FIG. 3E)

Data which are transferred from the CPU2 to the VRAM 7 are written into the VRAM data write register. When the upper byte of the data "VWR" is written thereinto, the video display controller 1 begins to write the data into the VRAM 7 and the address "MAWR" of the memory address write register is automatically incremented by one upon the writing of the data.

(f) VRAM data read register (register number "02", FIG. 3F)

Data which are transferred from the VRAM 7 to the CPU 2 are written into the VRAM data read register. When the upper byte of the data "VRR" is read therefrom, the reading of data is performed at the following address of the VRAM 7.

(g) Control register (register number "05", FIG. 3G)

An operating mode of the video display controller 1 is controlled in accordance with the following bits of the control register.

(1) bits 0 to 3 (IE) enable of interruption request (1.1) bit 0—collision detection of sprites (1.2) bit 1—excess number detection of sprites (1.3) bit 2—raster detection (1.4) bit 3—detection of vertical retrace period (2) bits 4 and 5 (EX)—external synchronism

| bit 5 | bit 4 | content |
|---|---|---|
| 0 | 0 | $\overline{VSYNC}$ and $\overline{HSYNC}$ are inputs, and synchronous to external signals |
| 0 | 1 | $\overline{VSYNC}$ is an input, and synchronous to external signals, while $\overline{HSYNC}$ is an output |
| 1 | 0 | non-used |
| 1 | 1 | $\overline{VSYNC}$ and $\overline{HSYNC}$ are outputs |

(3) bit 6 (SB)—sprite blanking

It is decided whether a sprite should be displayed on a screen or not. The control of the bit is effective in the following horizontal display period.

(3.1) "0"—blanking of a sprite (3.2) "1"—display of a sprite (4) bit 7 (BB)—background blanking It is decided whether background should be displayed on a screen or not. The control of the bit is effective in the following horizontal display period.

(4.1) "0"—blanking of background (4.2) "1"—display of background As a result, when the bits 6 and 7 are both "0", there is resulted in "burst mode" in which the following operations can be performed.

(3.4.1) The access to the VRAM 7 is not performed for a display, but the VRAM 7 is accessed by the CPU 2.

(3.4.2) DMA between two regions of the VRAM 7 is possible to be performed at any time.

In such an occasion, the terminals VD0 to VD7 are all "L", while the SPBG terminal is "H".

On the other hand, when the bits 6 and 7 are both "1", there is released from the "burst mode".

(5) bits 8 and 9 (TE)—selection of DISP terminal outputs

| bit 9 | bit 8 | output | DISP Content |
|---|---|---|---|
| 0 | 0 | DISP | output "H" during display |
| 0 | 1 | BURST | color burst inserting position is indicated by output "L" |
| 1 | 0 | INTHSYNC | internal horizontal synchronous signal |
| 1 | 1 | | non-used |

(6) bit 10 (DR)—dynamic RAM refresh

Refresh address is supplied from the terminals MA0 to MA15 upon the setting of the bit in a case where a VRAM dot width is of 2 dots or 4 dots for background in a memory width register as shown in FIG. 3K.

(7) bits 11 and 12 (IW)—increment width selection of the memory address write register or memory address read register A width which is incremented in address is selected as follows.

| bit 12 | bit 11 | increment width |
|---|---|---|
| 0 | 0 | +1 |
| 0 | 1 | +20H |
| 1 | 0 | +40H |
| 1 | 1 | +80H |

In a case of 8 bit access, an address is incremented upon the upper byte.

(h) Raster detecting register (register number "06", FIG. 3H)

A raster number "RCR" at which an interruption job is performed is written into the raster detecting register. An interruption signal is produced when a value of a raster counter is equal to the raster number "RCR". The raster counter is preset to be "64" at a preceding scanning raster line to a display starting raster line as described in more detail later, and is increased at each raster line by one.

(i) BGX scroll register (register number "07", FIG. 3I)

The BGX scroll register is used for a horizontal scroll of background on a screen. When a content "BXR" is re-written therein, the content is effective in the following raster line.

(j) BGY scroll register (register number "08", FIG. 3J)

The BGY scroll register is used for a vertical scroll of background on a screen. When a content "BYR" is re-written therein, the content is effective to be as "BYR+1" in the following raster line.

(k) Memory width register (register number "09", FIG. 3K)

(1) bits 0 and 1 (VM)—VRAM dot width

A dot width in which an access to the background attribute table and character generator, DMA and access of the CPU2 to the VRAM 7 during a horizontal display period are performed is written into the bits of the memory width register. The dot width is decided dependent on a memory speed of the VRAM 7. When the bits 0 and 1 are re-written therein, the content is effective at the beginning of a vertical retrace period.

| bit 1 | bit 0 | dot width | Disposition in one character cycle (8 dots) 1 | 2 | 3 | 4 | 5 | 6 | 7 | 8 |
|---|---|---|---|---|---|---|---|---|---|---|
| 0 | 0 | 1 | CPU | BAT | CPU | | CPU | CG0 | CPU | CG1 |
| 0 | 1 | 2 | BAT | | CPU | | CG0 | | CG1 | |
| 1 | 0 | 2 | BAT | | CPU | | CG0 | | CG1 | |
| | 1 | 4 | BAT | | | | CG0/CG1 | | | |

"BAT" is for background attribute table, and "CG" is for character generator.

(2) bits 2 and 3 (SM)—sprite dot width

A dot width in which an access to the sprite generator is performed during a horizontal retrace period is written into the bits of the memory width register.

| bit 3 | bit 2 | dot width | Disposition in one character cycle (8 dots) 1 | 2 | 3 | 4 | 5 | 6 | 7 | 8 |
|---|---|---|---|---|---|---|---|---|---|---|
| 0 | 0 | 1 | SP0 | SP1 | SP2 | SP3 | SP0 | SP1 | SP2 | SP3 |
| *0 | 1 | 2 | SP0 | | SP1 | | SP0 | | SP1 | |
| | | | SP2 | | SP3 | | SP2 | | SP3 | |
| 1 | 0 | 2 | SP0 | | SP1 | | SP2 | | SP3 | |
| **1 | 1 | 4 | | SP0 | | | | SP1 | | |
| | | | | SP2 | | | | SP3 | | |

(note)
*(SP0 SP1) or (SP2 SP3) is selected dependent on LSB bit of a pattern code.
**SP0 to SP3 are read in two consecutive character cycles.

(3) bits 4 to 6 (SCREEN)

The number of characters in X and Y directions of a fictitious screen is decided dependent on the content of the bits. When a content is re-written into the bits, the content is effective at the beginning of a vertical retrace period.

| bit | | | Number of characters | |
|---|---|---|---|---|
| 6 | 5 | 4 | X | Y |
| 0 | 0 | 0 | 32 | 32 |
| 0 | 0 | 1 | 64 | 32 |
| 0 | 1 | 0 | 128 | 32 |
| 0 | 1 | 1 | 128 | 32 |
| 1 | 0 | 0 | 32 | 64 |
| 1 | 0 | 1 | 64 | 64 |
| 1 | 1 | 0 | 128 | 64 |
| 1 | 1 | 1 | 128 | 64 |

(4) bit 7 (CM)—CG mode

When a VRAM dot width is of 4 dots, a color block of a character generator is changed dependent on the bit. A content is written into the bit, the content is effective in the following raster line.

(1) Horizontal synchronous register (register number "OA", FIG. 3L)

(1) bits 1 to 4 (HSW horizontal synchronous pulse

A pulse width of "L" level of a horizontal synchronous pulse is set as an unit of a character cycle. One of 1 to 32 is selected by using 5 bits to comply with a specification of a CRT display.

(2) bits 8 to 14 (HDS)—starting position of horizontal display

A period between a rising edge of a horizontal synchronous signal and a starting time of a horizontal display is set as an unit of a character cycle. An optimum position in the horizontal direction on a CRT display is decided by a content of the 7 bits. When it is assumed that a horizontal display position (horizontal back porch) is "N", "N−1" is written into the HDS bits.

(m) Horizontal display register (register number "OB", FIG. 3M)

(1) bits 0 to 6 (HDW)—horizontal display width

A display period in each raster line is set as an unit of a character cycle, and is decided in accordance with the number of characters in the horizontal direction on a CRT screen dependent on a content of the 7 bits. If it is assumed that a horizontal display position is "N", "N−1" is written into the HDW bits.

(2) bits 8 to 11 (HDE)—horizontal display ending position

A period between an ending of a horizontal display period and a rising edge of a horizontal synchronous signal is set as an unit of a character cycle. An optimum position of a horizontal display is set on a CRT display by the 7 bits. When it is assumed that a horizontal display ending position (horizontal back porch) is "N", "N−1" is written into the HDE bits.

(n) Vertical synchronous register (register number "OC", FIG. 3N)

(1) bits 0 to 4 (VSW)—vertical synchronous pulse width

A pulse width of a vertical synchronous signal is decided in a width of "L" level as an unit of a raster line. One of 1 to 32 is selected to comply with a specification of a CRT display.

(2) bits 8 to 15 (VDS)—vertical display starting position

A period between a rising edge of a vertical synchronous signal and a vertical synchronous starting position is set as an unit of a raster line. When it is assumed that a vertical display starting position (vertical back porch) is "N", "N−2" is written into the bits.

(c) Vertical display register (register number "OD", FIG. 30)

A vertical display period (display region) is set as an unit of a raster line. A vertical display width is decided in accordance with the number of raster lines to be displayed on a CRT display which is defined by a content of the 9 bits. When it is assumed that a vertical display width is "N", "N−1" is written into the VDW bits.

(p) Vertical display ending position register (register number "OE", FIG. 3P)

A period between a vertical display ending position and a rising edge of a vertical synchronous signal is set as an unit of a raster line. When it is assumed that a vertical optimum position (vertical front porch) is "N" to be defined by the 8 bits, "N" is written into the VCR bits.

(q) DMA control register (register number "OF", FIG. 3Q)

(1) bit 0 (DSC)—enable of interruption at the finishing of transfer between the VRAM7 and sprite attribute table buffer 23.

It is decided whether or not an interruption is enabled at the finishing time of the transfer.

(1.1) "0"—disable (1.2) "1"—enabled (2) bit 1 (DVC)—enable of interruption at the finishing of transfer between two regions of the VRAM 7.

It is decided whether or not an interruption is enabled at the finishing time of the transfer.

(2.1) "0"—disable (2.2) "1"—enabled (3) bit 2 (SI/D)—increment/decrement of a source address One of automatical increment and decrement of a source address is selected in a transfer between two regions of VRAM 7.

(4.1) "0"—increment (4.2) "1"—decrement (5) bit 5 (DSR) repetition of a transfer between the VRAM 7 and sprite attribute table buffer 23.

It is decided whether or not a repetition of a transfer between the VRAM 7 and sprite attribute table buffer 23 is enabled.

(r) DMA source address register (register number "10", FIG. 3R)

A starting address of a source address is allocated in a transfer between two regions of the VRAM 7.

(s) DMA destination address register (register number "11", FIG. 3S)

A starting address of a destination address is allocated in a transfer between two regions of the VRAM7.

(t) DMA block length register (register number "12", FIG. 3T)

A length of a block is defined in a transfer between two regions of the VRAM 7.

(u) DMA VRAM-SATB source address register (register number "13", FIG. 3U)

A starting address of a source address is allocated in a transfer between the VRAM7 and sprite attribute table buffer 23.

Figure 4A:
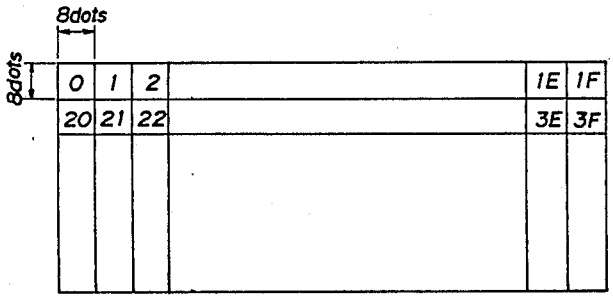
FIG. 4A is an explanatory diagram showing a fictitious screen in the embodiment according to the invention.

In FIG. 4A, there is shown an address in a background attribute table for a character on a fictitious screen. A character and color to be displayed at each character position are stored in the background attribute table. A predetermined number of background attribute tables are stored in a region the first address of which is "0" in the VRAM 7. The fictitious screen shown therein which is one example is of 32×32 characters ($1F_H=32_{10}$).

Figure 4B:
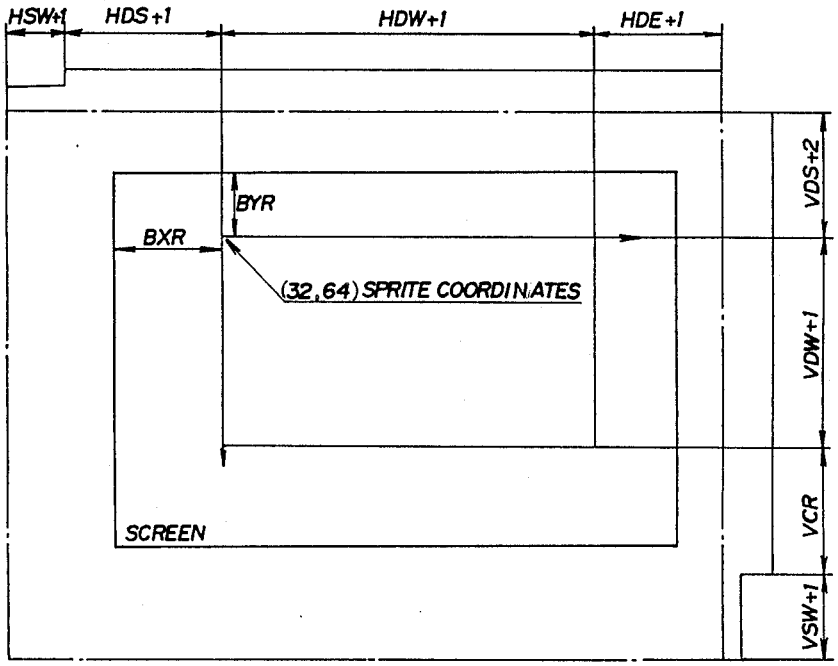
FIG. 4B is an explanatory diagram showing a display region on a screen in the embodiment according to the invention.

In FIG. 4B, there is shown a screen which is framed by writing respective predetermined values into the aforementioned horizontal synchronous register, horizontal display register, vertical synchronous register and vertical display register as shown in FIGS. 3L, 3M, 3N and 30. Although the respective predetermined values for the registers are not explained here, a display region is defined in accordance with "HDW+1" in the horizontal display register and "VDW+1" in the vertical display register. In the embodiment, the starting coordinates (x,y) for the display region is indicated to be as (32, 64).

Figure 5A:
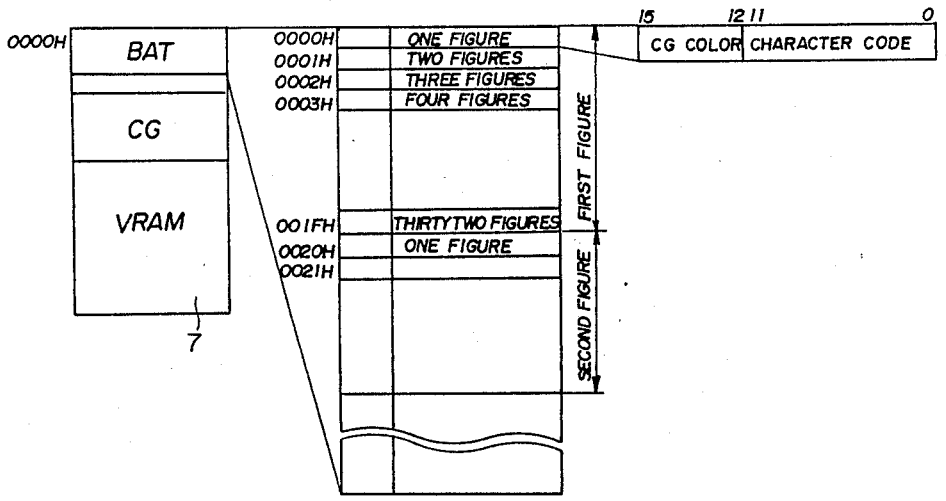
FIGS. 5A and 5B are explanatory diagrams showing a background attribute table in the VRAM in the embodiment according to the invention.
Figure 5B:
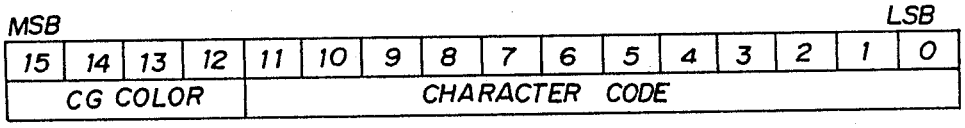

In FIGS. 5A and 5B, there are shown background attribute tables (BATs) in the VRAM 7 each of 16 bits to have a character code of lower 12 bits for designating a pattern number of a character and a CG color of upper 4 bits for designating a CG color code.

Figure 6A:
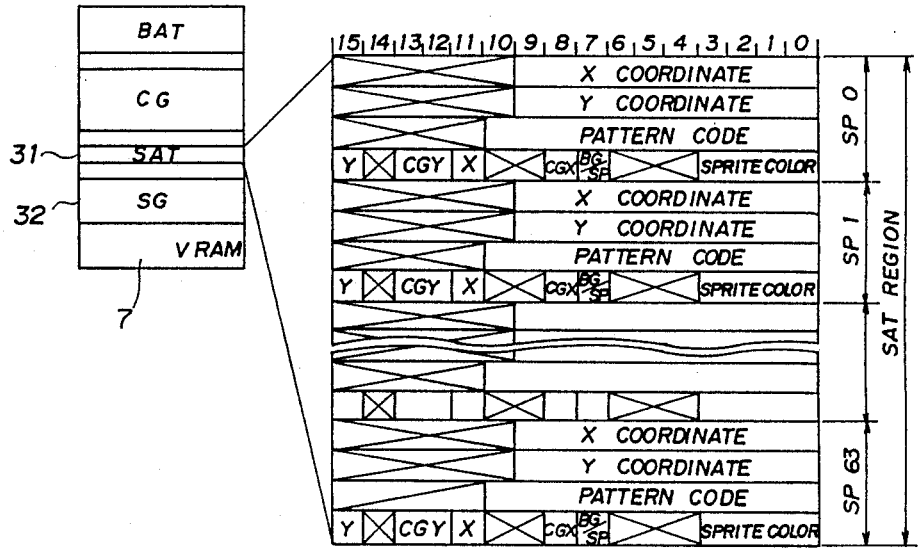
FIGS. 6A and 6B are explanatory diagrams showing a sprite attribute table in the VRAM in the embodiment according to the invention.
Figure 6B:
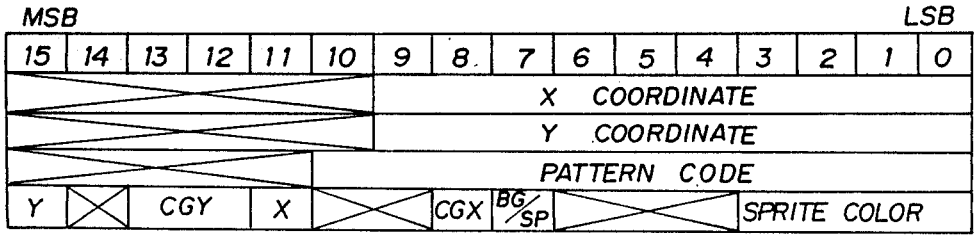

In FIGS. 6A and 6B, there are shown sprite attribute tables (SATs) 31 in the VRAM along with a sprite generator region 32. Each of the sprite attribute tables 31 is composed of 16×4 bits, that is, four words to define a sprite. Therefore, sixty-four sprites are defined by 256 words. In the sprite attribute table, lower 10 bits in the first word designate a horizontal position (0 to 1023) of a sprite. For this purpose, one of 0 to 1023 is written into an X coordinate therein. In the same manner, lower 10 bits in the second word designate a vertical position (0 to 1023) of a sprite, and one of 0 to 1023 is written into a Y coordinate therein. On the other hand, lower 11 bits in the third word is for a pattern number which is an address for a sprite generator 32, while the fourth word is for control bits including $\overline{Y}$ ($X_{15}$), CGY (two bits of $X_{13}$ and $X_{12}$), $\overline{X}$ ($X_{11}$), CGX($X_8$), BG/SP ($X_7$) and a color for a sprite (four bits of $X_3$ to $X_0$) in the direction of MSB to LSB.

The control bits are defined as follows.

(1) setting of $\overline{Y}$

A sprite is displayed to be reversed in the Y direction.

(2) setting of CGX

Two sprites consisting of a sprite to be addressed in the sprite generator 32 and the other sprite of the following address are displayed to be joined in the horizontal direction.

(3) setting of $\overline{X}$

A sprite is displayed to be reversed in the X direction.

(4) setting of CGY

The two bits $X_{13}$ and $X_{12}$ define three modes to be described in more detail later.

| | | |
|---|---|---|
| 0 | 0 | Normal |
| 0 | 1 | 2CGY |
| 1 | 0 | non-used |
| 1 | 1 | 4CGY |

(5) BG/SP

The bit $X_7$ designates a priority between displays of a background and sprite.

(5.1) "0"—background (5.2) "1"—sprite (6) sprite color

The bits $X_3$ to $X_0$ designate an area color of a sprite.

Each sprite has four facets to be called SG0 to SG3 each being of 16×16 dots so that one sprite occupies 64 words.

The writing of data into a sprite attribute table 31 is performed such that the data are not transferred from the CPU 2 directly to the VRAM 7, but in DMA transfer from the CPU2 to the sprite attribute table buffer 23.

Figure 7:
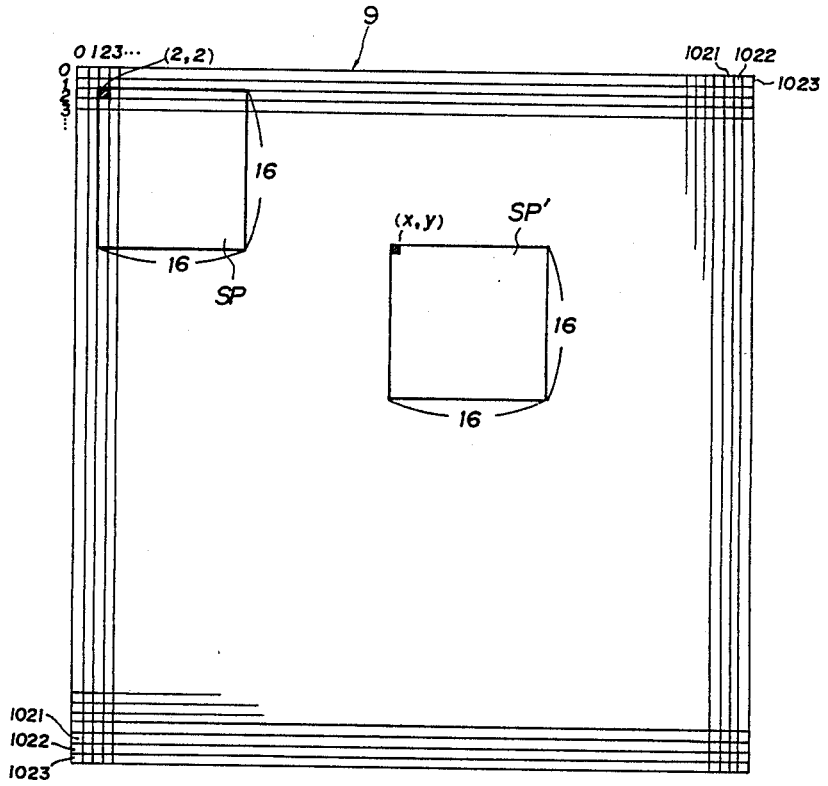
FIG. 7 is an explanatory diagram explaining a first operation in which a sprite is moved on a screen in the embodiment according to the invention.

In operation, a sprite SP having standard coordinates (2,2) is displayed on a display screen 9 having 1024 display dots respectively in the X and Y directions as shown in FIG. 7. In displaying the sprite SP thereon, the Y coordinates of the sixty-four sprite attribute tables 31 are compared in turn with a raster signal supplied from the scanning raster signal producing circuit 33 at the coincidence detection circuit 34 to pick up sprites each having a Y coordinate "2" which is then stored in its stripe number among the stripe numbers 0 to 63 into the pattern code buffer 35 when a horizontal display period of a scanning raster number "1" is started in the apparatus as shown in FIG. 2B. In this occasion, sixteen of sprites can be stored in the pattern code buffer 35 at the maximum. During a horizontal retrace period before which a scanning raster number "1" is finished and after which a scanning raster number "2" is started, address signals are produced in the selector 36 in accordance with the sprite numbers stored in the pattern code buffer 35 and pattern codes in the sprite attribute tables 31 so that pattern data are read from the sprite generator 32 in accordance with the address signals thus produced. The pattern data are stored in the pattern data buffer 37 along with X coordinates corresponding thereto in the sprite attribute tables 31. When a horizontal display period of the scanning raster number "2" is started, the X coordinates stored in the pattern data buffer 37 are compared with counted values of the horizontal dot clock counter 38 at the coincidence detection circuit 39. In the comparison, pattern data for the sprite sp are read to be supplied to the parallel/serial converting circuit 40 from the pattern data buffer 37 when the counted value corresponds to x=2. The parallel pattern data are converted into serial pattern data in the parallel/serial converting circuit 40 so that a picture element (2, 2) of the sprite sp is displayed on the CRT screen 9 in accordance with the serial pattern data passed through the gate circuit 42. Thereafter, fifteen picture elements (3, 2), (4, 2)—(17, 2) are displayed thereon to complete the display of the sprite sp on the y=2 raster line. As a matter of course, control data of the sprite attribute table 31 corresponding to the sprite sp are used to control the display thereof. In moving the sprite sp having the standard coordinates (2, 2) to a display position having a standard coordinates (X, Y) to be a sprite sp', the X and Y coordinates (2, 2) of the sprite attribute table 31 corresponding to the sprite sp are only changed to be X and Y coordinates (x, y) without changing contents of the sprite generator 32 and necessitating the re definition of a pattern. The sprites sp and sp' are displayed in accordance with the combination of more than one facets among the four facets SG0 to SG3.

Figure 8:
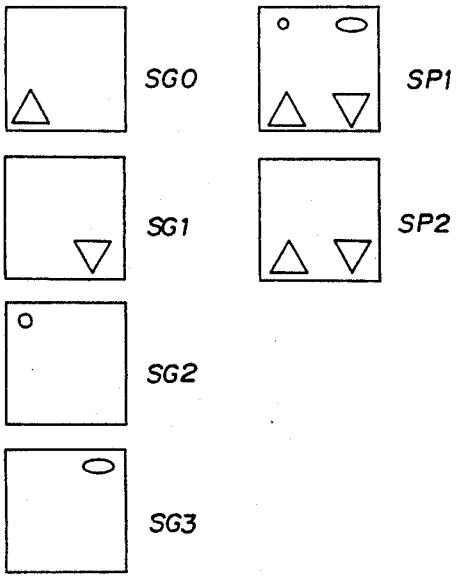
FIG. 8 is an explanatory diagram explaining a second operation in which a plurality of facets are combined to provide a sprite in the embodiment according to the invention.

Such a combination of facets SG0 to SG3 is shown in FIG. 8. For instance, all of the four facets SG0 to SG3 are combined to display a sprite $Sp_1$, while the facets SG0 and SG1 are combined to display a sprite $sp_2$. As clearly understood from the example, 24 display patterns are obtained in accordance with the calculation "4×3×2=24" so that a desired pattern can be selected from the 24 patterns in accordance with control data in a sprite attribute table. The four facets SG0 to SG3 are of different colors each to be designated by an area color code.

Next, the aforementioned CGX and CGY defined by control data in a sprite attribute table 31 are explained.

Figure 9:
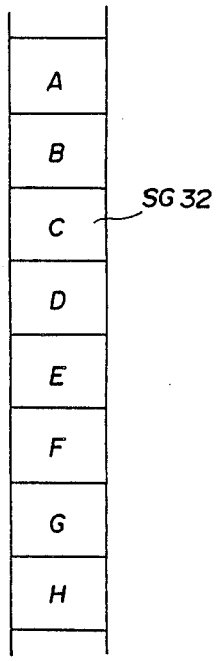
FIG. 9 is an explanatory diagram showing a sprite generator in the embodiment according to the invention.
Figure 10A:
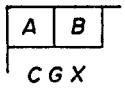
FIGS. 10A to 10E are explanatory diagrams showing a third operation in which a size of a sprite is enlarged in the embodiment according to the invention.
Figure 10B:
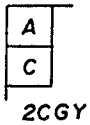
Figure 10C:
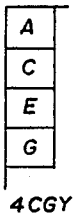
Figure 10D:
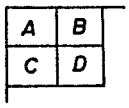
Figure 10E:
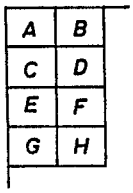

In FIG. 9, there is shown a sprite generator (SG) 32 comprising pattern data A, B, C—. In accordance with the definition of CGX and CGY as explained before, various kinds of sprite patterns each having a different color and size from others are obtained without increasing a memorizing area of the sprite generator 32 as shown in FIGS. 10A to 10E.

Further, $\overline{X}$, $\overline{Y}$, CGX and CGY are explained in more detail in conjunction with FIGS. 11A to 11C and FIGS. 12A to 12C.

Figure 11A:
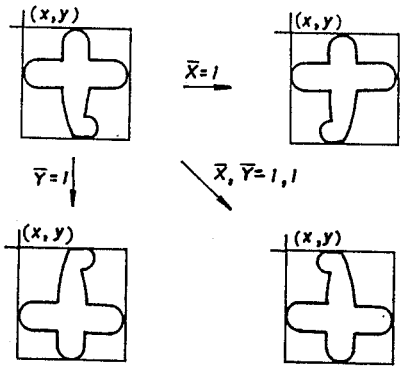
FIGS. 11A to 11C and 12A to 12C are explanatory diagrams showing a fourth operation in which a sprite is reversed, and a plurality of sprites are combined to enlarge the size thereof in the embodiment according to the invention.

In FIG. 11A, when a bit $\overline{X}$ in a sprite attribute table 31 is set to be "1", a sprite is displayed to be reversed in a left-side right manner. On the other hand, when a bit $\overline{Y}$ in the sprite attribute table 31 is set to be "1", the sprite is displayed to be reversed in an upside down manner. As a matter of course, when the bits $\overline{X}$ and $\overline{Y}$ are set to be "1", the sprite is displayed to be reversed in a left-side right and upside down manner.

Figure 11B:
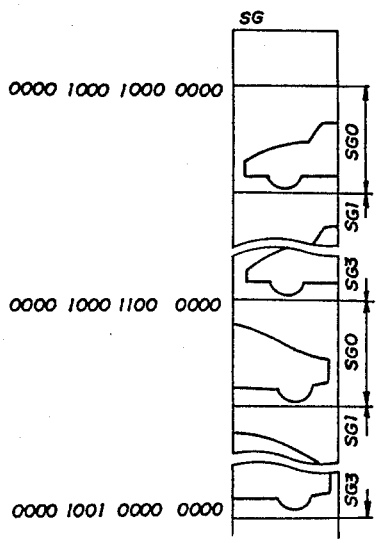
Figure 11C:
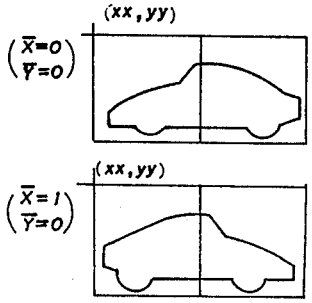

In FIGS. 11B and 11C, a CGX control mode as explained before is again explained. When a CGX bit is set to be "1", a sprite of an address designated by a pattern code in a sprite attribute table and a sprite of a preceding or following address to the designated address are displayed to be joined in the X direction. To be more concrete, if the designated address is "00001000110" as shown in FIG. 11B, a sprite of an address "00001000100" in which the bit X' is changed from "1" to "0" is positioned to the left, and a sprite of the designated address in which the bit $X_1$ is "1" is positioned to the right so that a sprite of the CGX mode is obtained as shown in FIG. 11C wherein two patterns of $\overline{X}=0$ and $\overline{Y}=0$, and $\overline{X}=1$ and $\overline{Y}=0$ are displayed.

Figure 12A:
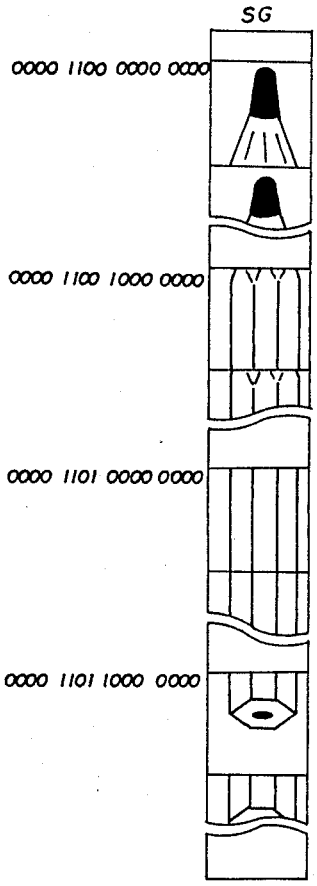
Figure 12B:
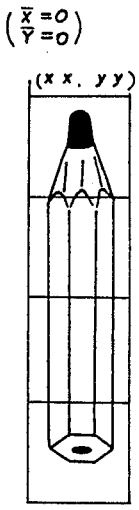
Figure 12C:
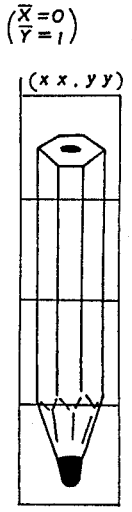

In FIGS. 12A to 12C, a CGY display mode as briefly explained before is again explained. In the CGY display mode, two bits $X_3$ and $X_2$ of a pattern code in a sprite attribute table are controlled so as to be (0, 0), (0, 1), (1, 0) and (1, 1). Therefore, if it is assumed that a pattern code in a sprite attribute table is "00001000110", an address map of a sprite generator is illustrated as shown in FIG. 12A. As a result, a sprite is displayed in 4CGY mode as shown in FIG. 12B wherein $\overline{X}$ and $\overline{Y}$ bits are not set to be "1" and in FIG. 2C wherein X bit is not set to be "1", while Y bit is set to be "1".

As clearly understood from the CGX and CGY display modes, a pattern size of a sprite is of $2\times16\times16$ dots in the CGX mode, and that of a sprite is of $4\times16\times16$ dots in the 4CGY mode so that the starting coordinates (x,y) of the display region are set to be (32, 64) in the embodiment. For the reason, the starting coordinates may be changed dependent on CGX and CGY modes.

Referring back to FIG. 2B, the starting coordinates (x,y) of the display region defined by $(HDW+1)\times(VDW+1)$ as explained in FIG. 4B is set in the start coordinates registration circuit 43 to be (32, 64). During the horizontal display period of a raster number "1", a counted value of the horizontal dot clock counter 38 and an X coordinate of the pattern data buffer 37 are compared with each other. In this comparison, pattern data having an X coordinate equal to the counted value are read from the pattern data buffer 37 to be converted from parallel to serial in the parallel/serial converting circuit 40. In this occasion, all of Y coordinates of the sprites are "1", while each of X coordinates of the sprites ranges from X to X+15, where X is a counted value of the horizontal dot clock counter 38 because each sprite is of $16\times16$ dots. Therefore, when the CGX display mode is performed, that ranges from X to X+31. Due to the fact that the Y coordinates are all "1", the serial pattern data can not be passed through the gate circuit 42 which is controlled in accordance with the starting coordinates (32, 64) of the start coordinates registration circuit 43 by the CPU 2 regardless of X coordinates thereof so that the pattern data are not displayed on the CRT screen 9. In this manner, the control of passing serial pattern data through the gate circuit 42 is performed in regard to a raster number 2, 3—k—by the CPU 2.

Thus, serial pattern data having a horizontal display position larger than 32 and vertical display position larger than 64 are passed through the gate circuit 42 to be displayed on the CRT screen 9. As a result, the blanking of a sprite can be performed so that a sprite is appeared smoothly from the top, bottom, left and right onto the CRT screen, and disappeared in the same manner.

In the control of displaying a sprite, the number of sprites to be designated in the coincidence detection circuit 34 is checked by the CPU 2. When the CPU 2 detects the number to be more than a predetermined number, sixteen in the embodiment, a warning signal is produced therefrom to indicate the occurrence on the CRT screen 9. In other words, the seventeenth sprite which is designated to be displayed is not displayed on the CRT screen 9.

In a case where all of pattern data for sprites to be designated are not transferred from the sprite generator 32 to the pattern data buffer 37 in a horizontal retrace period, it is understood in the CPU 2 that pattern data exceed a limitation of a display on the CRT screen 9. Such an excess pattern data are liable to be read from the sprite generator 32, for instance, in a case of CGX display mode as explained before.

Although the invention has been described with respect to specific embodiment for complete and clear disclosure, the appended claims are not to thus limited but are to be construed as embodying all modification and alternative constructions that may occur to one skilled in the art which fairly fall within the basic teaching herein set forth.

What is claimed is:

1. An apparatus for displaying a sprite on a display screen comprising:

sprite attribute tables each including coordinates indicating a display position of a sprite, a pattern code defining said sprite in regard to pattern data, and control data defining a display mode of said sprite;

first detection means for comparing a vertical position value of said coordinates with a raster number to detect a sprite to be displayed;

a sprite generator storing pattern data of said sprite;

second detection means for comparing a horizontal position value of said coordinates of said sprite to be displayed with a dot clock signal to detect pattern data to be displayed;

a pattern data buffer for storing pattern data of said sprite to be displayed in accordance with the reading thereof from said sprite generator;

means for storing standard coordinates of a display region on said screen;

a gate circuit for providing said pattern data stored in said pattern data buffer to said screen; and means for controlling said screen to display said sprite to be displayed thereon in accordance with said pattern data to be displayed, wherein said controlling means decides selectively an allowance or an inhibition of said transmission of said pattern data in accordance with a comparison of said coordinates indicating said display position with said standard coordinates.

2. An apparatus for displaying a sprite on a display screen according to claim 1, wherein:

said storing means stores starting coordinates of said display region; and said controlling means inhibits said transmission of said pattern data when said coordinates indicate said display position is less than said starting coordinates.

3. An apparatus for displaying a sprite on a display screen according to claim 2, wherein:

said storing means stores said starting coordinates determined in accordance with contents of a horizontal period register, a horizontal display register, a vertical synchronism register, and a vertical display register.

4. An apparatus for displaying a sprite on a video display responsive to display scan information supplied by a vertical scanning raster register and a horizontal dot clock counter, comprising:

a memory for storing a sprite attribute table, said table including coordinates indicating a display position of a sprite, a pattern code defining said sprite, and display control data defining a display mode of said sprite;

a first coincidence detector for comparing a vertical position value of said coordinates stored in said memory with a raster number supplied by the vertical scanning register to detect a sprite to be displayed;

a sprite generator storing pattern data of said sprite to be displayed;

a pattern data buffer for storing pattern data from said sprite generator of said sprite to be displayed;

a second coincidence detector for comparing a horizontal position value of said coordinates of said sprite to be displayed from said memory with a dot clock signal supplied by the horizontal dot clock counter and, in response, supplying a portion of said pattern data to be displayed received from said pattern data buffer;

a start coordinates registration circuit for storing boundary coordinates defining a display region;

a controller receiving said boundary coordinates from said start coordinates registration circuit and, in response to detecting a display position within said boundary coordinates, generating a display control signal; and a gate circuit for receiving said portion of said pattern data from said pattern data and, in response to said display control signal from said controller, providing said portion of said pattern data to said video display.

* * * * *